US011418878B1

(12) United States Patent
Liu et al.

(10) Patent No.: US 11,418,878 B1
(45) Date of Patent: Aug. 16, 2022

(54) SECONDARY PATH IDENTIFICATION FOR ACTIVE NOISE CANCELLING SYSTEMS AND METHODS

(71) Applicant: SYNAPTICS INCORPORATED, San Jose, CA (US)

(72) Inventors: Wensen Liu, Irvine, CA (US); Govind Kannan, Irvine, CA (US)

(73) Assignee: SYNAPTICS INCORPORATED, San Jose, CA (US)

( * ) Notice: Subject to any disclaimer, the term of this patent is extended or adjusted under 35 U.S.C. 154(b) by 0 days.

(21) Appl. No.: 17/221,599

(22) Filed: Apr. 2, 2021

(51) Int. Cl.
*H04R 3/02* (2006.01)
*H04R 1/10* (2006.01)

(52) U.S. Cl.
CPC ..... *H04R 3/02* (2013.01); *H04R 1/1016* (2013.01)

(58) Field of Classification Search
None
See application file for complete search history.

(56) References Cited

U.S. PATENT DOCUMENTS

2008/0140868 A1 6/2008 Kalayjian
2009/0131124 A1 5/2009 Bibaud
2009/0156126 A1 6/2009 Willis
2010/0159840 A1 6/2010 Rosener
2011/0092157 A1 4/2011 Clark
2011/0312279 A1 12/2011 Tsai
2012/0015605 A1 1/2012 Sole
2013/0094668 A1 4/2013 Poulsen
2013/0114823 A1 5/2013 Kari
2013/0162459 A1 6/2013 Aharony
2014/0155000 A1 6/2014 Erkens
2017/0208382 A1* 7/2017 Grinker ..... G10K 11/1785
2018/0182371 A1* 6/2018 Thormundsson ..... G10K 11/17833

* cited by examiner

*Primary Examiner* — Kenny H Truong
(74) *Attorney, Agent, or Firm* — Paradice & Li LLP

(57) ABSTRACT

An active noise cancellation system has a secondary path including a loudspeaker configured to output an anti-noise signal to cancel noise in a noise cancellation zone, and an error microphone configured to sense sound in the noise cancellation zone. The ANC system further includes a logic device configured to adaptively generate the anti-noise signal for playback through the loudspeaker based at least in part on a feedback signal from the error microphone and identify a user of the active noise cancellation system based, at least in part, on a measured frequency response of the secondary path. The logic device is further configured to identify the user of the active noise cancellation system through a comparison of the measured frequency response of the secondary path to stored models and may be configured to execute a new user enrollment process, store user profiles, and/or switch between in-ear and open-air states.

20 Claims, 8 Drawing Sheets

SECONDARY PATH IDENTIFICATION FOR ACTIVE NOISE CANCELLING SYSTEMS AND METHODS

TECHNICAL FIELD

The present application relates generally to noise cancelling systems and methods, and more specifically, for example, to active noise cancelling (ANC) systems and methods for use in earphones, earbuds, hearing aids, and other in-ear personal listening devices.

BACKGROUND

Active noise cancellation systems commonly operate by sensing ambient noise through a reference microphone and generating a corresponding anti-noise signal that is approximately equal in magnitude, but opposite in phase, to the sensed noise. The noise and anti-noise signal cancel each other acoustically, allowing the user to hear only a desired audio signal. To achieve this effect, a low-latency filter path from the reference microphone to a loudspeaker that outputs the anti-noise signal may be implemented. In operation, conventional anti-noise filtering systems do not completely cancel all noise, leaving residual noise and/or generating audible artefacts that may be distracting to the user. Performance of these active noise cancellation systems may be further degraded due to leakage, which may vary from person-to-person and device-to-device.

Many personal listening devices are designed to be positioned in the ear, in or adjacent to the user's ear canal, when in use and enter a low power mode to save battery power when not in use. Some ANC devices can detect whether it is positioned in the user's ear through the use of dedicated sensors and/or other position sensing hardware that is added to the personal listening device. However, in small, low power devices, these additional hardware components consume additional power, add to the size and complexity of the device, and can further increase manufacturing costs.

In view of the foregoing, there is a continued need for improved active noise cancellation systems and methods for earphone, earbuds and other in-ear personal listening devices.

SUMMARY

Systems and methods are disclosed for improved active noise cancellation in personal listening devices. In various embodiments, for example, improved ANC performance includes identifying a user through a secondary path identification process, optimizing the ANC processing for the identified user, and configuring operation based on detected in-ear/open-air states.

In some embodiments, an active noise cancellation system has a secondary path including a loudspeaker configured to output an anti-noise signal to cancel noise in a noise cancellation zone, and an error microphone configured to sense sound in the noise cancellation zone. The ANC system further includes a logic device configured to adaptively generate the anti-noise signal for playback through the loudspeaker based at least in part on a feedback signal from the error microphone and identify a user of the active noise cancellation system based, at least in part, on a measured frequency response of the secondary path. The logic device is further configured to identify the user of the active noise cancellation system through a comparison of the measured frequency response of the secondary path to stored models and may be configured to execute a new user enrollment process, store user profiles, and/or switch between in-ear and open-air states.

In some embodiments, a method for operating an active noise cancellation system includes generating, by a signal processor, an anti-noise signal adapted to cancel ambient noise, outputting, through a loudspeaker, the anti-noise signal to cancel the ambient noise, sensing, by an error microphone, a mix of sounds comprising the ambient noise and the anti-noise signal, feeding back the sensed mix of sounds to the signal processor for use in adapting the anti-noise signal, and identifying a user of the active noise cancellation system based, at least in part, on a measured frequency response of a secondary path comprising the loudspeaker and the error microphone.

The method may further include identifying the user of the active noise cancellation system through a comparison of the measured frequency response of the secondary path to stored models, loading a stored user profile associated with the identified user when the identified user is a known user, and/or executing an enrollment process when then identified user is a new user. The enrollment process may further include configuring and storing an active noise cancellation profile for the identified user based on tracking active noise cancellation tuning parameters and/or user preferences.

In some embodiments, the method includes generating the stored models by identifying one or more users, instructing each user to insert an in-ear active noise cancellation device while sound is emitted through the loudspeaker, measuring a secondary path frequency response for the user and active noise cancellation device while it is inserted into an ear of the user, and storing a secondary path frequency response model and user identification data. The method may further include identifying the user of the active noise cancellation system based, at least in part, on a measured frequency response of the secondary path, by detecting use of an in-ear active noise cancellation device, measuring the secondary path frequency response of the user while sound is emitted from the loudspeaker, determining whether the measured secondary path frequency response matches a stored user model, and when a match is found, identifying the user to a host system and load an associated user profile. The user profile may include stored coefficients for at least one adaptive filter of the active noise cancellation system, and the method may further include adapting filter coefficients of at least one adaptive filter in active noise cancellation system.

In some embodiments, the method includes sensing the ambient noise through a reference microphone and generating a reference signal corresponding thereto, and sensing, through the error microphone, a mix of the ambient noise and the anti-noise signal and generating a corresponding error signal. In some embodiments, the method includes detecting coupling of an in-ear active noise cancellation device to an ear of the user, wherein the coupling determination comprises an in-ear state or open-air state.

The scope of the disclosure is defined by the claims, which are incorporated into this section by reference. A more complete understanding of embodiments of the disclosure will be afforded to those skilled in the art, as well as a realization of additional advantages thereof, by a consideration of the following detailed description of one or more embodiments. Reference will be made to the appended sheets of drawings that will first be described briefly.

BRIEF DESCRIPTION OF THE DRAWINGS

Aspects of the disclosure and their advantages can be better understood with reference to the following drawings and the detailed description that follows. It should be appreciated that like reference numerals are used to identify like elements illustrated in one or more of the figures, wherein showings therein are for purposes of illustrating embodiments of the present disclosure and not for purposes of limiting the same. The components in the drawings are not necessarily to scale, emphasis instead being placed upon clearly illustrating the principles of the present disclosure.

DETAILED DESCRIPTION

Figure 1:
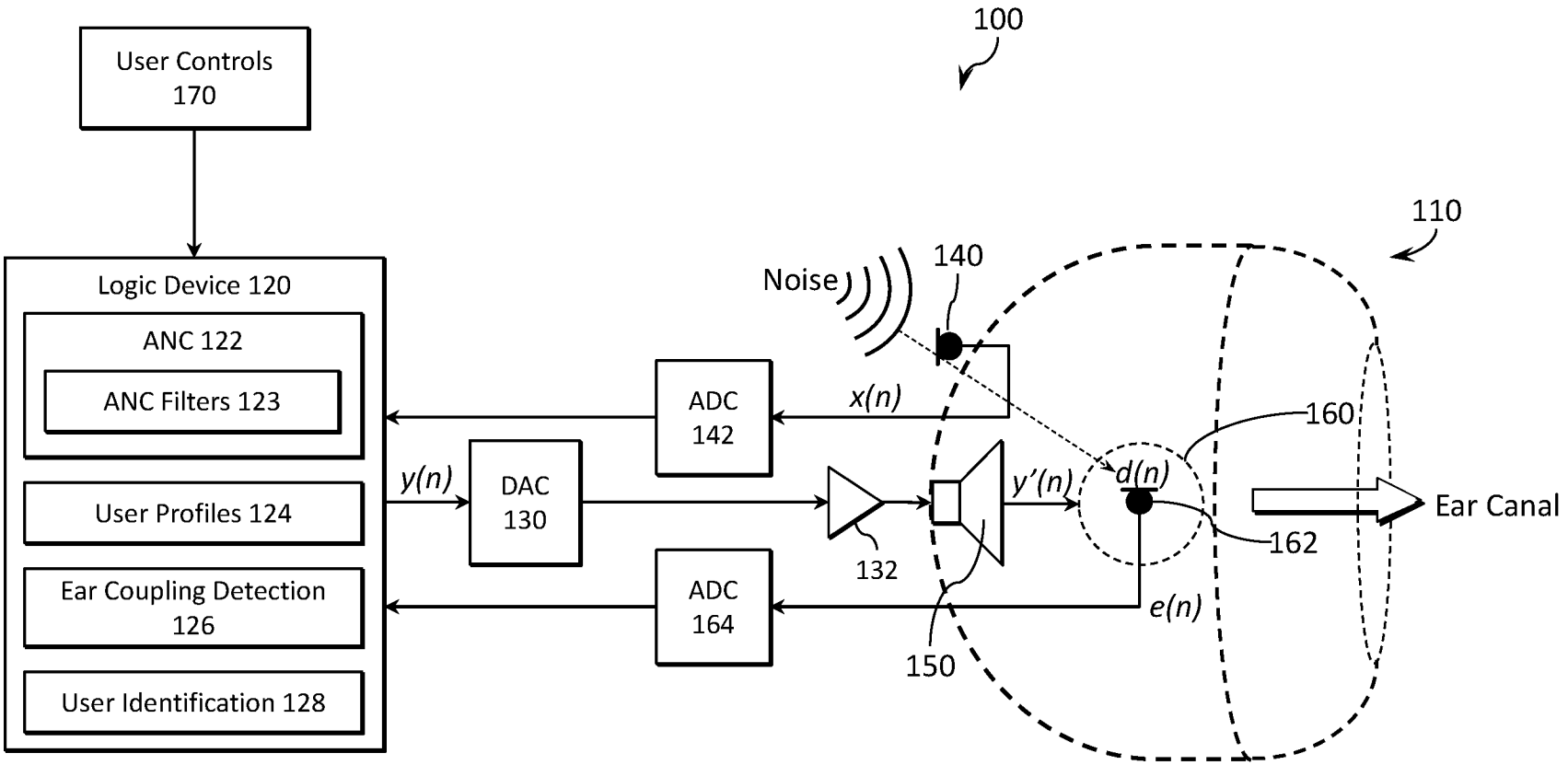
FIG. 1 illustrates an active noise cancellation device, in accordance with one or more embodiments of the present disclosure.
Figure 2A:
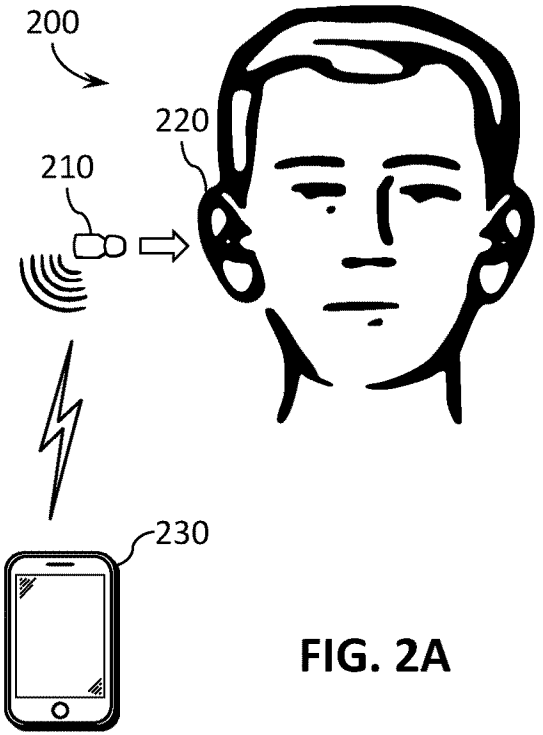
FIGS. 2A, 2B, 2C and 2D illustrate ear coupling of a personal listening device, in accordance with one or more embodiments of the present disclosure.
Figure 2B:
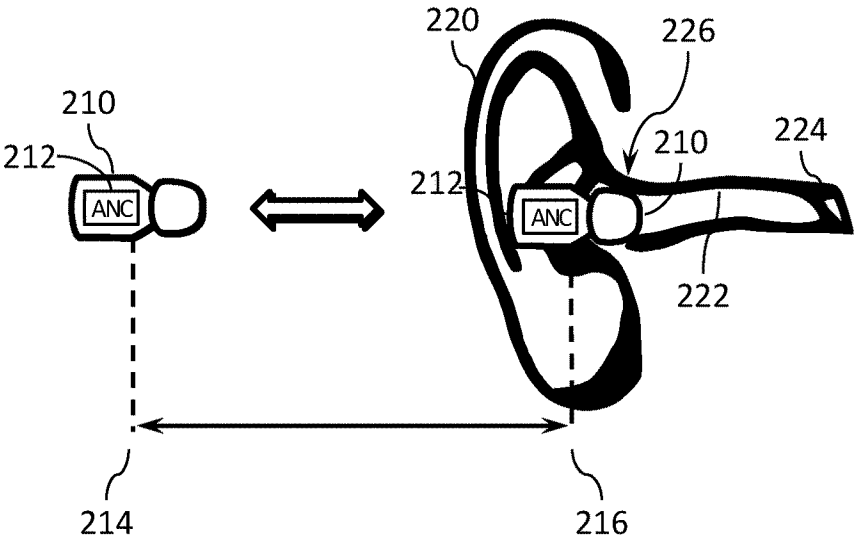
Figure 2C:
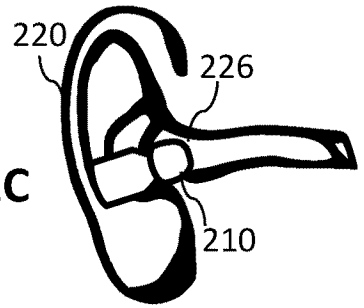
Figure 2D:
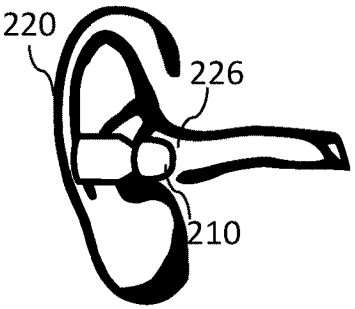

In accordance with various embodiments, improved active noise cancellation (ANC) systems and methods are disclosed. An ANC system for a personal listening devices, such as earphones, earbuds, or other in-ear personal listening devices may include a noise sensing reference microphone for sensing ambient noise external to the personal listening device, an error microphone for sensing an acoustic mixture of the noise and anti-noise generated by the ANC system, and a low latency signal processing sub-system that generates the anti-noise to cancel the sensed ambient noise. The signal processing sub-system may be configured to adapt the anti-noise signal in real-time to the ambient noise, the coupling of the personal listening device with respect to the user, user-selectable modes and other factors to achieve consistent noise cancellation performance. In various embodiments, the systems and methods disclosed herein improve cancellation of ambient noise under various ear coupling and leakage scenarios, while providing efficient, low-power processing.

It is recognized that high leakage can result in a breakdown of ANC performance. For example, a feedback ANC path tracks and adapts to an error microphone signal, which may typically provide a good measure of ANC performance at the user's ear drum. However, in the presence of higher leakage, the loudspeaker may not be physically able to push enough air to achieve desired performance at the ear drum. The present disclosure addresses these and other leakage issues by selecting ANC profiles for identified different users. In some embodiments, the ANC system is configured with a plurality of user profiles adapted for corresponding scenarios relating to the positioning and/or fit of the listening device with respect to the user's anatomy. The user profiles may include, for example, modeling for a tight seal between a personal listening device and the user's ear, and modeling of one or more leakage paths associated with leaky device positions and/or fit conditions.

In some embodiments, the ANC system analyzes the secondary path from the ANC loudspeaker to the ANC error microphone to identify the user and/or an ear coupling state. The identity of the user may be used, for example, to select an appropriate user profile for ANC operation or to identify the user to a host system (e.g., user authentication processes). The ear coupling state may be used, for example, to control volume and/or power management between in-ear and open-air states.

It is recognized that ears are physically different from person to person resulting in different fits between an ANC device and the ear. Embodiments disclosed herein detect differences in a secondary path response to identify an individual user wherein the personal listening device, allowing custom user profiles (e.g., leakage profiles), user configurations and preferences, and other settings to be optimized for the user.

In some embodiments, the secondary path response is monitored to detect coupling and/or uncoupling of the ANC device to/from the ear. For example, the ANC device may be configured to emit a sound through the loudspeaker and measure a frequency response at the ANC error microphone. The frequency response may be affected by the position of the ANC device with respect to the ear, the fit of the ANC device to the ear which may include leakage, the structure of the ear, and other physical properties. It is observed in test environments that the frequency response from the ANC speaker to the error microphone is measurably different from person to person, allowing the secondary path frequency response to be used for acoustic biometrics to identify individual users. In some embodiments, secondary path acoustic biometrics may be used to configure the ANC device for the user to provide optimal noise cancellation and audio playback according to the user's preferences. The secondary path acoustic biometrics may also be used for authentication or other identification processes by a host device, either alone or in combination with other identification techniques (e.g., password authentication, fingerprint biometrics, voice biometrics, face recognition, etc.).

The secondary path acoustic biometrics may also be used to determine whether the ANC device is coupled to the user's ear—e.g., in an in-ear state or open-air state. For example, the secondary path acoustic biometrics may be used to identify the person wearing the ANC device, which indicates an in-ear state. If no person is identified and/or detected (e.g., in the case of an unknown user) then the ANC device is not being worn, which indicates an open-air state. In some embodiments, when the ANC device is removed from the user's ear the secondary path acoustic biometrics will no longer identify the user and a notification may be sent to the host device to pause playback, enter a low power mode, change volume setting, and/or execute another desired process.

In some embodiments, the ANC device is configured to periodically measure the secondary path response and compare the measured response to on-ear and open-ear model. In some embodiments, one or more open-air models are generated (e.g., from individual users during an enrollment process, sample models from a manufacturer, aggregate models generated from stored user models, etc.) and stored.

A duty cycle can be used to intermittently measure the secondary path response, which may include periodic playback of a sample sound. If the headset has an off-ear detector (e.g., a separate sensor) then that information may be used in conjunction with the secondary path response to confirm an on-ear or off-ear state. For in-ear/open-air detection, the system may use audio played through the device (e.g., music played by the user), temporarily transmit new audio (e.g., white noise, pink noise, music, etc.) during the measurement, and/or play a sound outside of the range of human hearing (e.g., a high frequency sound or low frequency sound that will not disrupt the user while measuring the secondary path response).

The host device is configured, in some embodiments, with an initialization/enrollment process and an authentication process. The initialization/enrollment process is configured to generate and store a unique secondary path frequency response model for a user. In some embodiments, the host device sends a sound through the ANC loudspeaker, such as white noise, pink noise, music, a sinusoidal wave, or other sound, and measures the secondary path frequency response at the ANC error microphone. While the sound is playing, the individual may be instructed to insert and remove the in-ear personal listening device multiple times (e.g., 5 times) to measure the secondary path frequency response across multiple device/ear couplings. The measured frequency responses are used to generate a model describing the unique device/user fit (e.g., a model of the average frequency response across the plurality of in-ear insertions). The host device may also prompt the user for further identifying information, such as the person's name or username to associate with the user model.

After the enrollment process, the host device may identify a user of the in-ear ANC device by measuring the secondary path frequency response. For this process, the host device stores the individual's user model (e.g., generated through the enrollment process described above), models from other users, and/or other sample models. When the user inserts or otherwise activates the ANC device, the host device may transmit an audio signal for output through the loudspeaker of the ANC device (e.g., music, a far-end voice signal on a voice call, audio from video, audio selected by the user, a sample tone/noise, etc.) and measure the secondary path frequency response at the error microphone. The measured secondary path frequency response is compared against the stored models to find a user match. In some embodiments, the measured secondary path frequency response is compared against each stored model to determine a degree of fit (e.g., a calculated confidence level indicative of the fit between the two models). Because each person has a unique biometric response, the model with the best fit can be used to identify the user. In some embodiments, a confidence factor is calculated, and a best fit is determined by identifying the stored model with the highest confidence factor that exceeds a pre-determined threshold. In some embodiments, the model fit between the sample response and the stored models is calculated using normalized root mean square error (NRMSE) or other model fit process as known in the art. In some embodiments, if no model has an associated confidence level above the pre-determined threshold, then no user is identified through this process.

In some embodiments, the secondary path response is measure by playing a sound, recording the sound by the error microphone and removing the playback through components of the ANC device (e.g., digital signal processing components). The modeled secondary path response may include the magnitude and phase of the response across an audio frequency spectrum (e.g., 10 Hz to 100,000 Hz). In some embodiments, the secondary path response is measured separately for each ear of the user, generating two models for use in user identification.

Example embodiments of active noise cancelling systems of the present disclosure will now be described with reference to the figures. Referring to FIG. 1, an active noise cancelling system 100 includes a personal listening device 110 adapted for insertion into a user's ear and audio processing components, which may include a programmable logic device 120 (e.g., a digital signal processor, microprocessor and memory, etc.) configured to provide low latency signal processing, a digital to analog converter (DAC) 130, an amplifier 132, a reference audio sensor 140, a loudspeaker 150, an error sensor 162, and/or other components. It will be appreciated that the embodiment illustrated in FIG. 1 is an illustrative example and that systems comprising other components and/or combinations of components may be used to implement the systems and methods disclosed herein.

In operation, a listener may hear external noise d(n), passing through the housing and components of the personal listening device 110. To cancel the noise d(n), the reference audio sensor 140 senses the external noise, producing a reference signal x(n) which is fed through an analog-to-digital converter (ADC) 142 to the logic device 120. The logic device 120 may include hardware and/or software configured to generate an anti-noise signal y(n), which is fed through the DAC 130 and the amplifier 132 to the loudspeaker 150 to generate anti-noise in a noise cancellation zone 160. The noise d(n) will be cancelled in the noise cancellation zone 160 when the anti-noise is equal in magnitude and opposite in phase to the noise d(n) in the noise cancellation zone 160. The resulting mixture of noise and anti-noise is captured by the error sensor 162 which generates an error signal e(n) to measure the effectiveness of the noise cancellation. The error signal e(n) is fed through ADC 164 to the logic device 120, which adapts the anti-noise signal y(n) to minimize the error signal e(n) within the cancellation zone 162 (e.g., drive the error signal e(n) to zero). In some embodiments, the loudspeaker 150 may also generate desired audio (e.g., music) which is received by the error sensor 162 and removed from the error signal e(n) during ANC processing.

In various embodiments, the personal listening device 110 may include earphones, earbuds, hearing aids, and other in-ear personal listening devices. The personal listening device 110 may be a standalone device, such as a hearing aid, or be implemented as an audio listening device connected (e.g., physically and/or wirelessly) to one or more external devices, such as a computer (e.g., desktop, laptop, notebook, tablet), mobile phone, audio playback device (e.g., an MP3 player), video game system, or another device. The reference audio sensor 140 and the error sensor 162 may comprise one or more audio sensors, transducers, microphones or other components configured to detect a sound and convert the detected sound into an electrical audio signal.

The logic device 120 includes digital processing components that may include a single sample processor, digital signal processor, a controller, a central processing unit with program instructions stored in memory, and/or other logic device configured to perform one or more of the processes disclosed herein. The logic device 120 may include programmed logic and/or hardware components for causing the logic device 120 to perform certain processes including ANC processing (e.g., through ANC logic 122), user profile selection and/or switching (e.g., through user profile logic 124), detection of ear coupling status, which may include detecting whether the user is wearing the device (e.g., ear coupling detection logic 126), and user identification and/or authentication (e.g., user identification logic 128). The logic device 120 may receive instructions, such as ANC and/or user profile configuration parameters, from user controls 170, which may include one or more physical buttons, sliders, dials or other physical input components, a touch-screen with associated graphical user interface, or other user input device, component or logic.

It will be appreciated that the embodiment of FIG. 1 is one example of an active noise cancellation system and that the systems and methods disclosed herein may be implemented with other active noise cancelling implementations that include an error microphone. It will further be appreciated that the embodiment of FIG. 1 may be used with additional components in various embodiments, including audio playback components for receiving and generating a playback signal for output (e.g., music, audio from a voice conference) through the loudspeaker 150.

Embodiments incorporating ear coupling detection, user identification, and user profile selection and switching will now be described in further detail. Referring to FIGS. 2A-D, a personal listening device, such as a wireless earbud 210, is adapted to fit into an ear 220 of a user 200. In operation, the wireless earbud 210 is operable to communicate wirelessly with a host system, such as host device 230. The wireless earbud 210 is designed to be inserted into the user's ear canal 222 (or in the ear and adjacent to the ear canal) where the audio output from the wireless earbud 210 is sensed at the user's ear drum 224. The wireless earbud 210 includes a wireless transceiver for transmitting and receiving communications (e.g., audio streams) between the wireless earbud 210 and the host device 230.

The user 200 will insert and remove the wireless earbud 210 into and from, respectively, the user's ear 220 as desired to listen to audio from the host device 230. During this process, the wireless earbud 210 passes between a first position 214 in the open air to a second position 216 where the wireless earbud 210 is securely positioned in the ear 220. In various embodiments, the wireless earbud 210 includes a soft tip (e.g., silicon, memory foam) that is designed to conform to the shape of the ear to create a tight seal that controls leakage. However, in practice when the wireless earbud 210 is positioned in the second position 216, one or more gaps 226 and/or loose couplings/seals may be formed between the wireless earbud 210 and the anatomy of the user's ear 220 resulting in leakage.

Small variations in coupling are expected in practice as a user inserts and removes the wireless earbuds, which can be addressed through adaptive ANC filtering. However, larger gaps 226 may be formed that result in a leaky condition that cannot be accounted for with standard ANC filtering, for example, due to the user's particular anatomy, the positioning of the wireless earbud 210 (e.g., a misalignment of the earbud relative to the ear, improper insertion depth, etc.), the size and shape of the wireless earbud 210, changes to the shape of the earbud due to use, the user not recognizing when proper coupling is achieved and/or other factors.

The wireless earbud 210 includes an ANC system 212 to cancel ambient noise and/or passthrough certain ambient noise in a transparency mode. During operation, the adaptive components of the ANC system 212 adapt to optimize ANC performance. In some embodiments, the ANC system 212 tracks one or more leakage parameters (e.g., gain parameters) to identify a leakage scenario and loads a corresponding leakage profile to optimize ANC performance. In some embodiments, the ANC system 212 identifies a user (e.g., through a secondary path impulse response process as described herein) and loads a corresponding user profile configured to optimize ANC performance for the user, including with respect to the fit of the wireless earbud to the ear 220 of the user.

The various leakage conditions can be modeled, and a corresponding profile configured, for example, by testing position and fit scenarios using a dummy head and optimizing ANC parameters for the detected leakage conditions, by testing people in the general population, by modeling the parameters of the ANC system, and/or other methods. It is observed that for a sample of the population of potential users, leakage scenarios often fall within two or three clusters, and in most cases, four or five clusters may be sufficient for acceptable performance. These clusters or other groupings can be used to define leakage profiles including adaptive filters tuned for the leakage scenario.

In some embodiments, the ANC system 212 analyzes the secondary path from the ANC loudspeaker to the ANC error microphone (e.g., loudspeaker 150 and error sensor 162 of FIG. 1) to identify the user and/or an ear coupling state. It is recognized that ears are physically different from person to person resulting in a different fit between an ANC device and the ear. The host device 230, ANC system 212 and/or other logical components are configured to detect differences in the secondary path to identify the individual user, select custom user profiles (e.g., leakage profiles), user configurations and preferences, and/or other settings to be optimized for the user. In some embodiments, the ear coupling state is monitored to trigger a change in an operation of the wireless earbud 210 based on the in-ear/open-air state, such as entering a low power mode, adjusting the output volume, and activating or disabling certain functions, etc.

In some embodiments, the secondary path is monitored to detect coupling and/or uncoupling of the wireless earbuds 210 to the ear, such as along the path between the first position 214 and the second position 216. For example, the wireless earbuds 210 may be configured to emit a sound through the loudspeaker and measure the frequency response at the ANC error microphone. The frequency response may change with changes in the position of the wireless earbuds 210 with respect to the ear 220, the fit of the wireless earbuds 210 in the ear 220 which may include leakage, the structure of the ear, and other physical properties.

In some embodiments, the wireless earbuds 210 are configured to monitor the frequency response of the secondary path to determine whether the wireless earbud 210 are in the user's ear 220 or not. If the wireless earbuds are removed from the user's ear 220, then a notification may be sent to the host device to pause playback, enter a low power mode, change volume setting, or desired process. If the wireless earbuds 210 are inserted into the ear 220, then the wireless earbuds 210 may be instructed to wake up from a low power mode, adjust volume in view of the proximity to the ear drum 224, or perform other desired processes.

It is observed in test environments that the frequency response from the ANC loudspeaker to the error microphone is different from person to person, allowing the frequency response to be used for acoustic biometrics to identify individual users. The acoustic biometrics may be used to configure the wireless earbuds for the user to provide optimal noise cancellation and audio playback for the user 200. The acoustic biometrics may also be used for authentication or other identification processes by the host device 230, either alone or in combination with other identification technique (e.g., password authentication, fingerprint biometrics, voice biometrics, face recognition, etc.). The ANC processing can also be optimized based on user identification, which may include selecting an appropriate configuration profile for the ANC, for example, in accordance with user preferences, anticipated leakage profiles, or other configurations.

The host device 230 is configured, in some embodiments, with an initialization/enrollment process and an authentication process. The enrollment process is configured to generate and store a unique frequency response model for a user. In some embodiments, the host device 230 instructs the wireless earbud 210 to emit a sound through the ANC loudspeaker, such as white noise, pink noise, music, a sinusoidal wave, or other sound, and measures the frequency response at the error microphone. While the sound is playing, the individual is instructed by the host device 230 (e.g., via an application displaying a graphical user interface to the user 200) to insert and remove the wireless earbud 210 multiple times (e.g., 5 times). The user 200 can then move the wireless earbud between an open-air position 214 and inserted position 216 as instructed, during which the host device tracks the frequency response. The measured frequency responses are used to generate a unique model for the user (e.g., using the average frequency response from the in-ear position 216). The host device 230 may also prompt the user 200, for example through a graphical user interface, for further identifying information, such as the person's name or username to associate with the user model. Although FIGS. 2A-D only the user's right ear is shown, the same procedure can also be used to generate a frequency response model for a wireless earbud inserted into the user's the left ear.

After the enrollment process, the host device 230 may identify a particular user of the wireless earbud 210 by comparing the frequency response of the secondary path of the wearer to stored models. For this process, the host device 230, wireless earbud 210, or other processing device connected to the wireless earbud 210 stores known user models, which may include models generated for other users and/or sample user models. When the user 200 inserts or otherwise activates the ANC device, the host device 230 may transmit an audio signal for output through the loudspeaker of the ANC device (e.g., music, a far-end voice signal on a voice call, audio from video, etc.) and measure the frequency response at the error microphone. The measured frequency response is compared against the stored models to determine the fit to the model (e.g., a calculated level of confidence of the fit of the measured frequency response to each model). Because each person has a unique biometric response, the model with the best fit can be used to identify the user. In some embodiments, a confidence factor is calculated, and a fit is determined only if the confidence factor exceeds a pre-determined threshold. In some embodiments, the model fit between the measured response and the stored models is calculated using a normalized root mean square error (NRMSE) process or other model fit process as known in the art.

To determine an ear coupling state, the wireless earbud 210 periodically measures the frequency response of the secondary path and compares the model to in-ear and open-air models. A duty cycle can be used to regularly check the response, which may include periodic playback of a sample sound. If the headset has an open-air detector (e.g., a separate sensor) then that information may be used in conjunction with the secondary path response in making the open-air determination. For ear coupling determinations, the system may play a sound outside of the range of human hearing (e.g., a high frequency sound or low frequency sound that will not disrupt the user).

Figure 3:
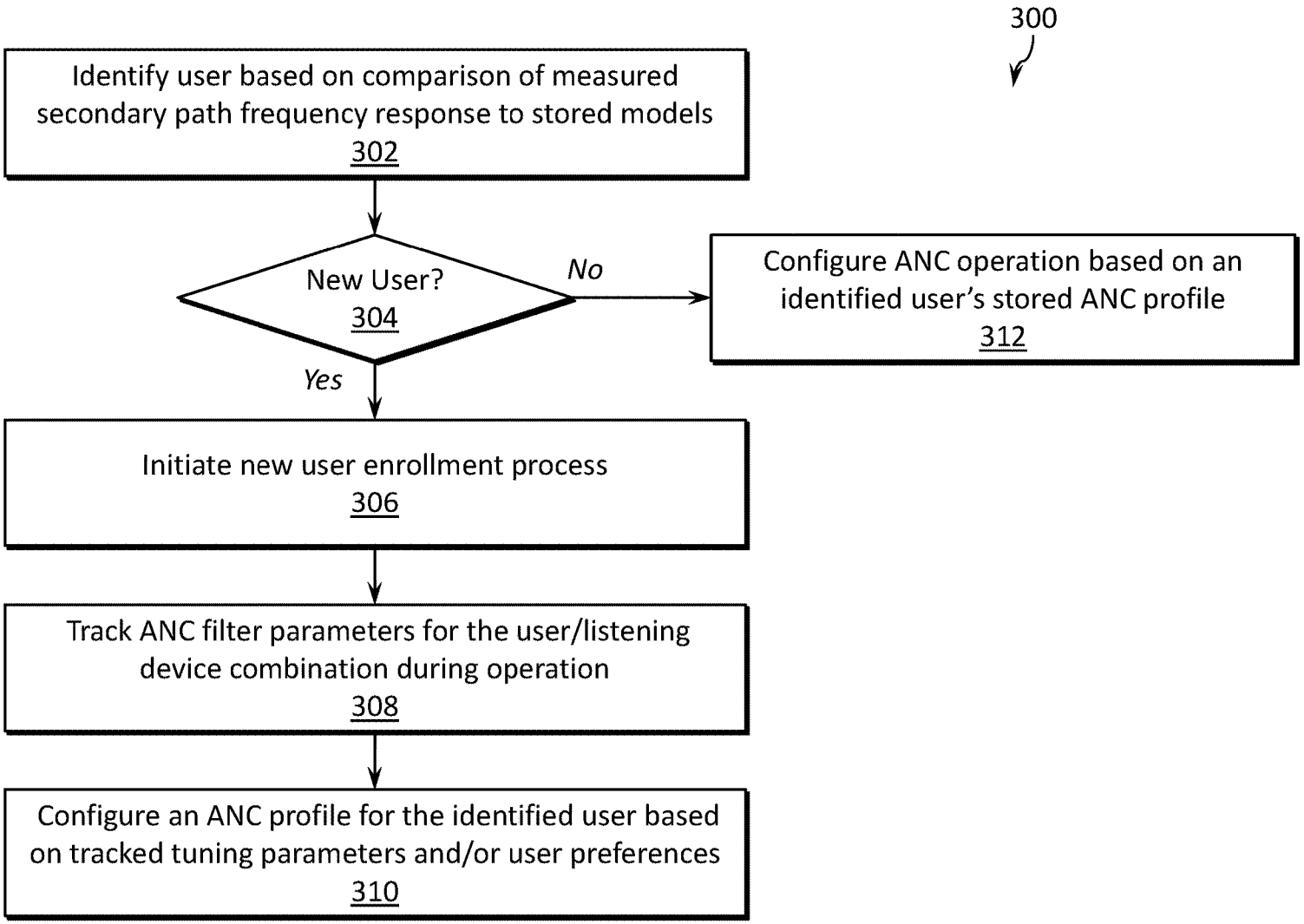
FIG. 3 illustrates an example process for operating an ANC system using secondary path identification, in accordance with one or more embodiments.

Referring to FIG. 3, a method 300 for operating the ANC systems (e.g., the systems of FIGS. 1 and 2A-2D) using measured secondary path frequency response will now be described, in accordance with one or more embodiments. In step 302, a user inserts one or more earbuds into his/her ears and the ANC system and/or host measures the frequency response between an ANC loudspeaker/ANC error sensor pair. The measured frequency response is affected by factors unique to the user such as the physical structure of the user's ear and the fit of the earbud into the ear. In various embodiments, the system combines (e.g., averages) two or more frequency response measurements to generate a model for the current user.

The generated model is compared to stored models to identify the user. In some embodiments, the comparison is performed using a statistical best-fit process to match the current user with the stored profiles, including a confidence factor or other measure indicating the degree of fit between the generated model and stored models. If the user is matched to an existing profile (e.g., if the confidence factor exceeds a predetermined threshold value indicating a match with a stored profile), then the user is identified.

In step 304, if the current user is a new user to the system, then then operation proceeds with an unknown user, for example, using a default user profile. In some embodiments, when a new user is detected, an enrollment process is initiated (step 306) by the host to generate and store a secondary path frequency response model for the user and associate the model with a user identifier and/or user configuration profile. In step 308, for example, the system tracks ANC filter parameters (e.g., leakage parameters) for the user/listening device combination during operation. In step 310, the system configures and stores an ANC profile for the identified user based on the generated frequency response model, tracked tuning parameters and/or user preferences set by the user during operation.

Referring back to step 304, if the current user is matched to an existing user profile using the measured secondary path frequency response, then in step 312 ANC operation is configured based on the identified user's stored ANC profile, which may include, for example, a leakage profile and user preferences (e.g., transparency mode settings, volume controls, etc.). In some embodiments, a number of leakage profiles are defined (e.g., four profiles), representing variations in coupling between the personal listening device and a person's ear or head. The profiles may be selected to cover a range of leakage factors and/or a range of common personal listening device configurations and positions/fits, such as a tight coupling configuration, an open air (or highly leaky) configuration and intermediate leaky scenarios. The ANC system may be configured to detect a leakage scenario (e.g., by tracking adaptive ANC parameters) and select an appropriate leakage profile for further use by the current user.

An embodiment of a method 400 for generating stored secondary path frequency response models for a personal listening device will now be described with reference to FIG. 4A. In step 402, the system identifies one or more people to model. In various embodiments, the stored secondary path models include known users of the personal listening device and/or sample user models. In step 404, a host system separately guides each identified user through the modeling process, including instructing each user to insert and remove the earbud a plurality of times while the earbud emits sound from an earbud loudspeaker.

In step 406, the system measures the secondary path frequency response while the earbud is inserted in the user's ear. By instructing the user to remove and insert the earbuds multiple times (e.g., 5 times), the host system can take measurements under multiple fit conditions. A user secondary path frequency response model is generated based on the plurality of in-ear measurements. In some embodiments, the in-ear measurements are verified to confirm the measurements are consistent with an in-ear condition and then combined (e.g., averaged) to generate the user secondary path frequency response model. In some embodiments, measurements are taken in each and the user secondary path frequency response model includes a left ear model and a right ear model. In step 408, the user's secondary path frequency response model and user identification data are stored for later use in user identification.

Figure 5:
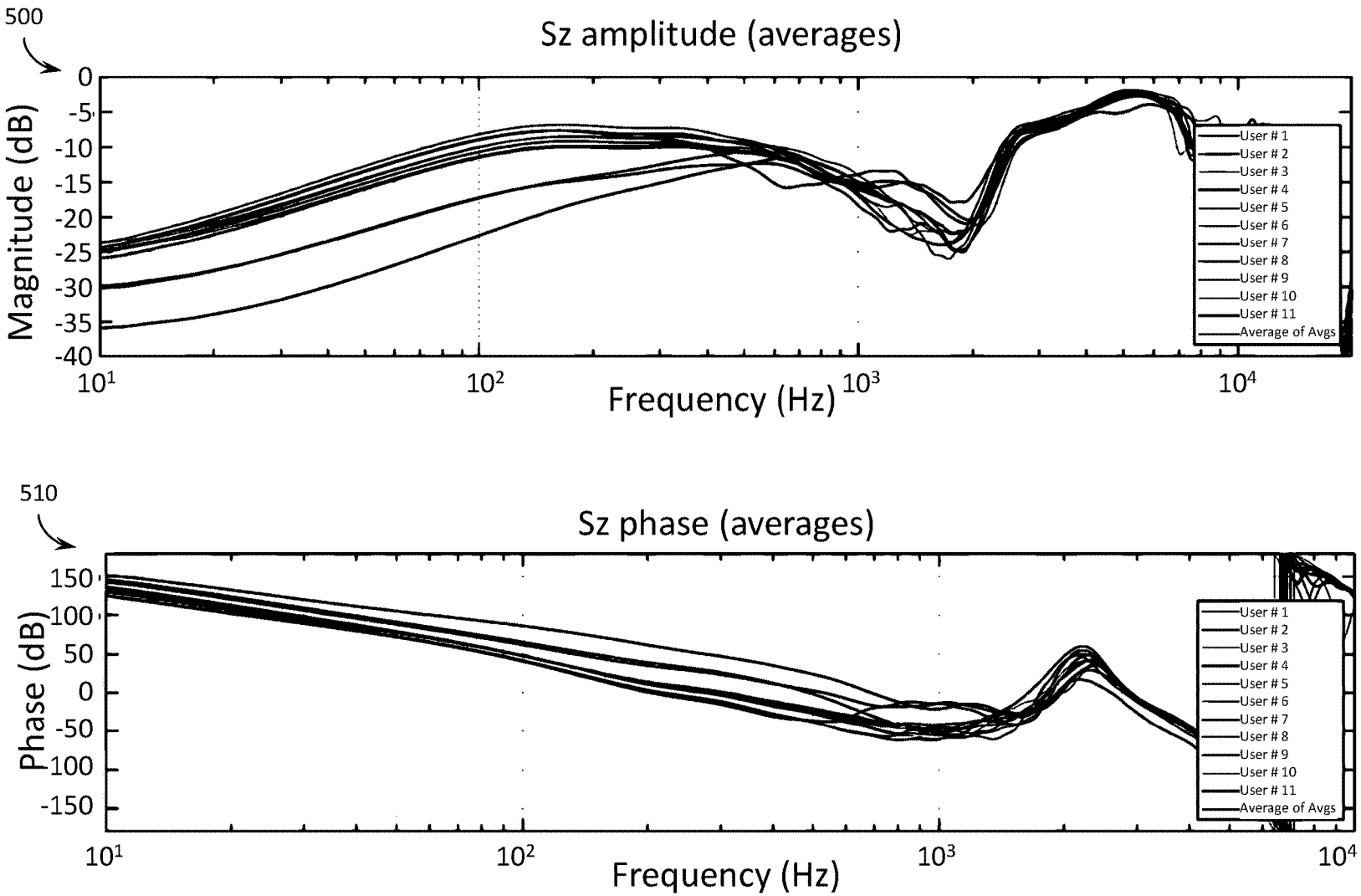
FIG. 5 illustrates example views of stored user identification models, in accordance with one or more embodiments.

An example of models stored for user identification as described herein is illustrated in FIG. 5. As illustrated the stored models include data for 11 users (User #1-11). The data for each user includes an average of the measured magnitude (sample magnitude data for the 11 users is plotted in chart 500) and phase (sample phase data for the 11 users is plotted in chart 510) across a frequency spectrum. It will be appreciated that the secondary path frequency response data may be represented in other forms, such as through other measurements, formats, units, and ranges. It will also be appreciated that the stored secondary frequency response models may include data from one or more user.

Figure 4B:
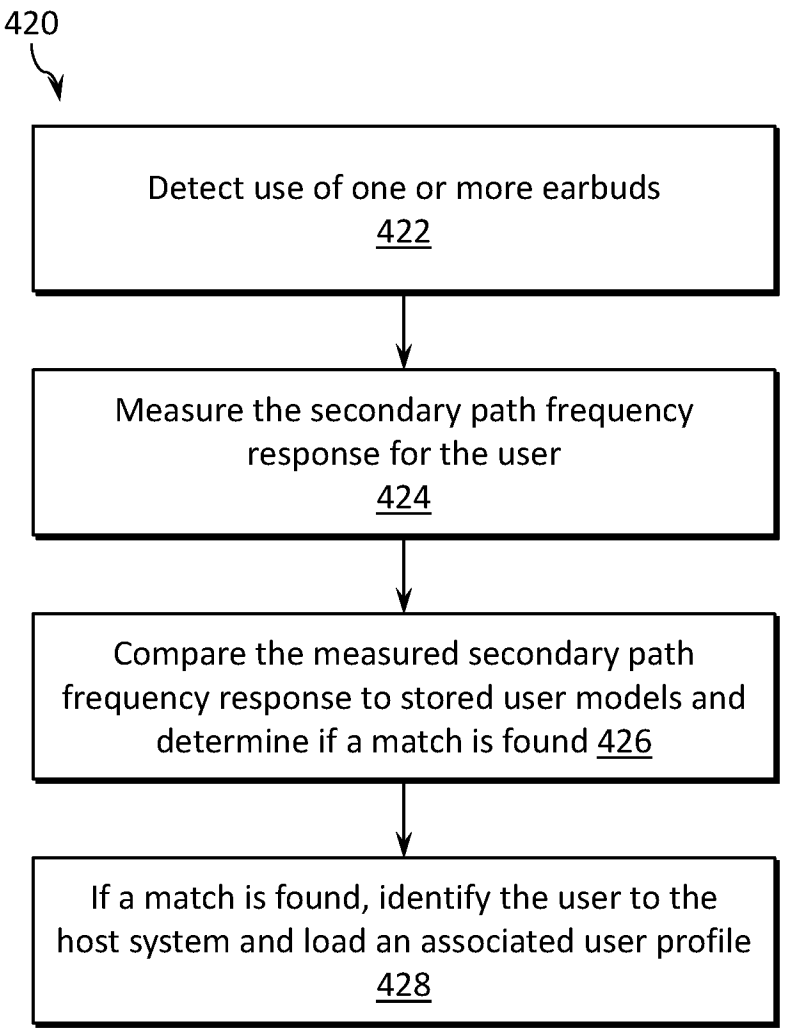
FIG. 4B illustrates an example process for identifying a user based on a secondary path identification process, in accordance with one or more embodiments.
Figure 4A:
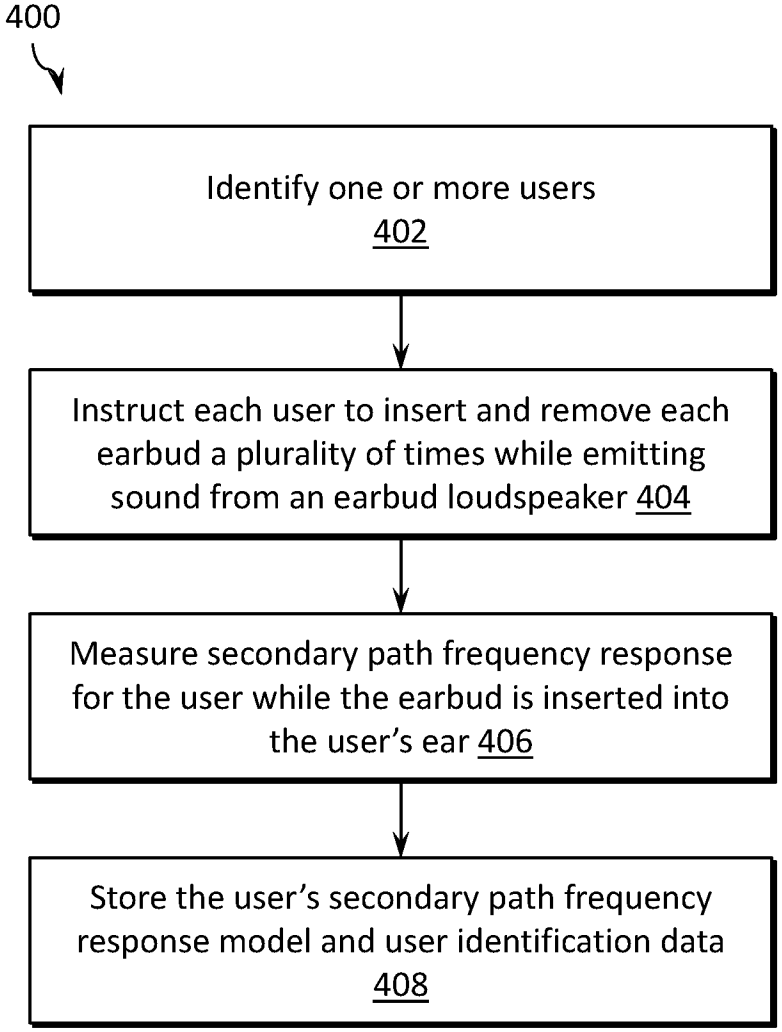
FIG. 4A illustrates an example process for generating stored secondary path identification models, in accordance with one or more embodiments.

Referring to FIG. 4B, a process 420 for identifying a user based on measured secondary path frequency response will now be described, in accordance with one or more embodiments. In step 422, the use of one or more earbuds is detected by a host device and/or the processing components of the earbud(s). In one embodiment, an in-ear state is detected using the secondary path frequency response measurements as described herein, and/or through other components and methods, such as use of a sensor.

In step 424, the secondary path frequency response for the user is measured for one or more earbuds. In one embodiment, a plurality of measurements are taken from both the left earbud and the right earbud while sound is emitted from the earbud loudspeaker. The sound may be generated by the host device in response to user input, and may include any audible sound such as music, speech, a tone, etc. In some embodiments, if no sound is being played, the host system may send an audio sample to the earbuds through the loudspeaker, such as white noise, pink noise, a tone, etc., allowing the frequency response to be measured. In various embodiments, the earbuds include ANC processing components including an error microphone and the frequency response from the earbud loudspeaker to the error microphone is measured.

In step 426, the measured secondary path frequency response is compared to stored user models to determine if a match is found. In various embodiments, the measured response is compared to each of the stored models using a statistical best fit method such as a normalized root mean square error calculation. The comparison may generate a confidence score or other measure of the degree of fit to each of the stored models. In some embodiments, a match will be found if the stored model with the best fit (e.g., the stored model with the highest associated confidence score) has a confidence score above a pre-determined threshold. Otherwise, the user is not identified through this process.

In some embodiments, the measured data for each of the left and right earbuds is separately compared to the left and right frequency response models and the results are combined to determine an identification. In various embodiments, a user may be identified if the measurements from one of the left or right earbuds is a match for a stored model, if the measurements from both of the left and right earbuds are matches for a stored model, if an average confidence score for the left and right earbuds exceeds a predetermined threshold, and/or through other statistical data fitting processes. If a match is found then, in step 428, the user is identified to the host device and an associated user profile is loaded for operating the earbuds.

Figure 6A:
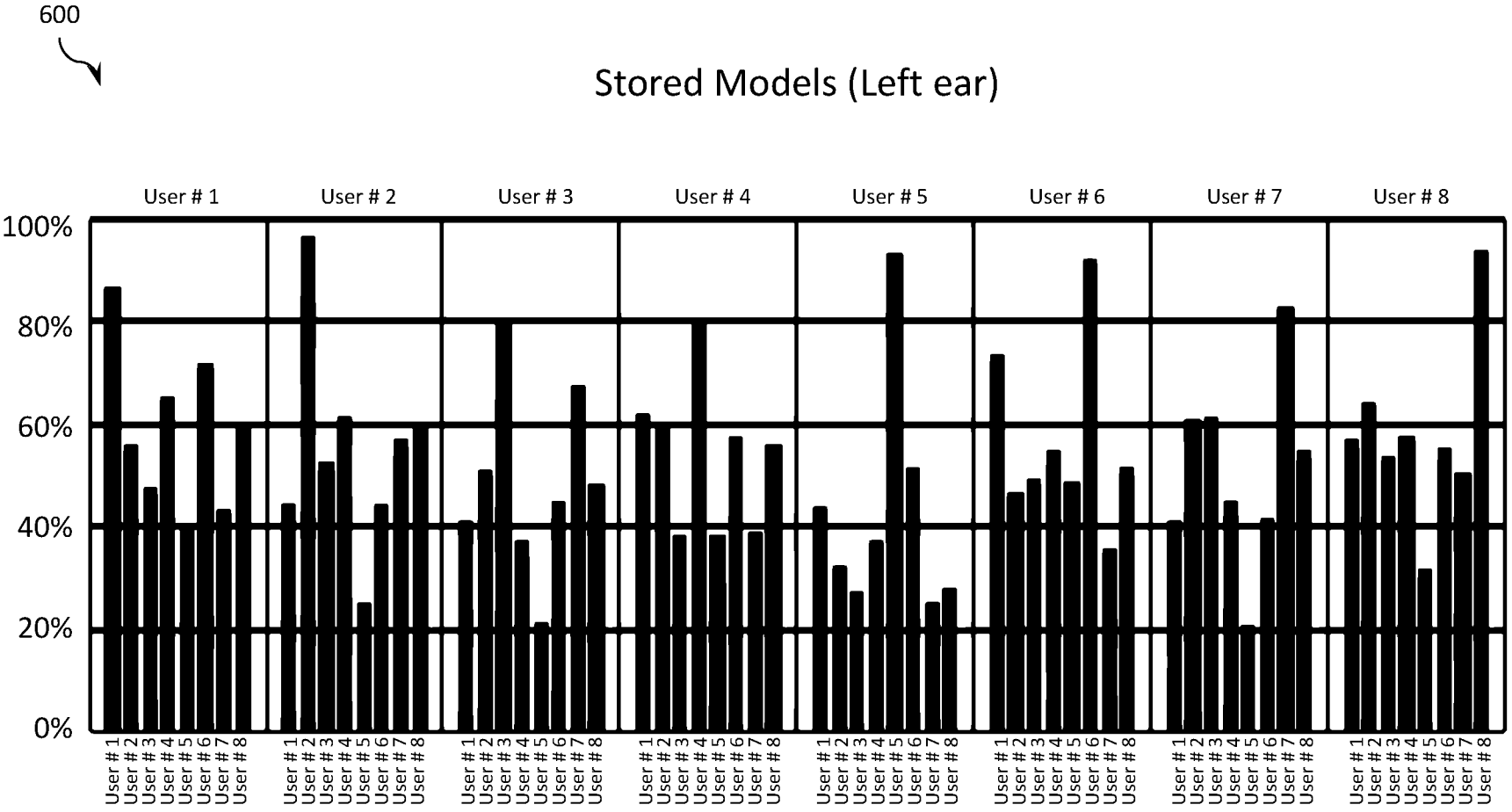
FIGS. 6A and 6B illustrate example secondary path identification analysis for a plurality of users, in accordance with one or more embodiments.
Figure 6B:
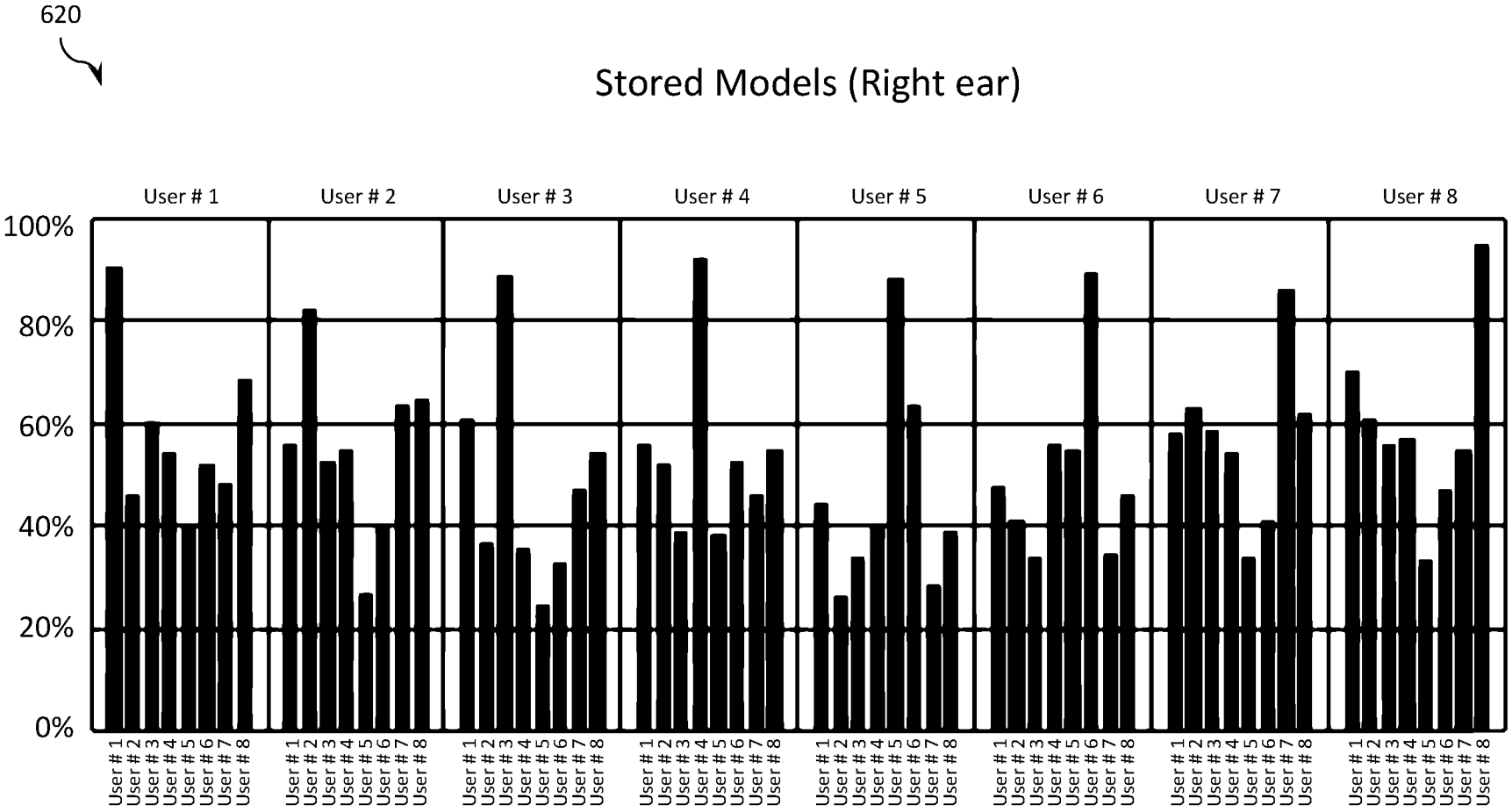

FIGS. 6A and 6B are representations of a sample datasets generated in a test environment for a user's left ear (chart 600) and right ear (chart 620). A set of ANC earbuds were modeled for eight users (user #1-8). Each user was instructed to insert and remove each of the left and right earbuds four times to generate four secondary path frequency response measurements. The four measurements for each of the left and right ears were averaged together to generate 8 user models. A fifth set of left/right measurements was taken from each user and compared against the 8 stored models to generate confidence scores.

The chart 600 illustrates the confidence scores for the measurements taken by the left earbud. As shown, the confidence scores for each user peaked above 75% when compared against the user's stored model. The chart 620 illustrates the confidence scores for the measurements taken by the right earbud, and also shows that the confidence scores for each user peaked above 75% when compared against the user's stored model. It will be appreciated that the data presented in FIGS. 6A and 6B is an example, and that other personal listening devices and groups of users will present different data profiles and results.

Figure 7:
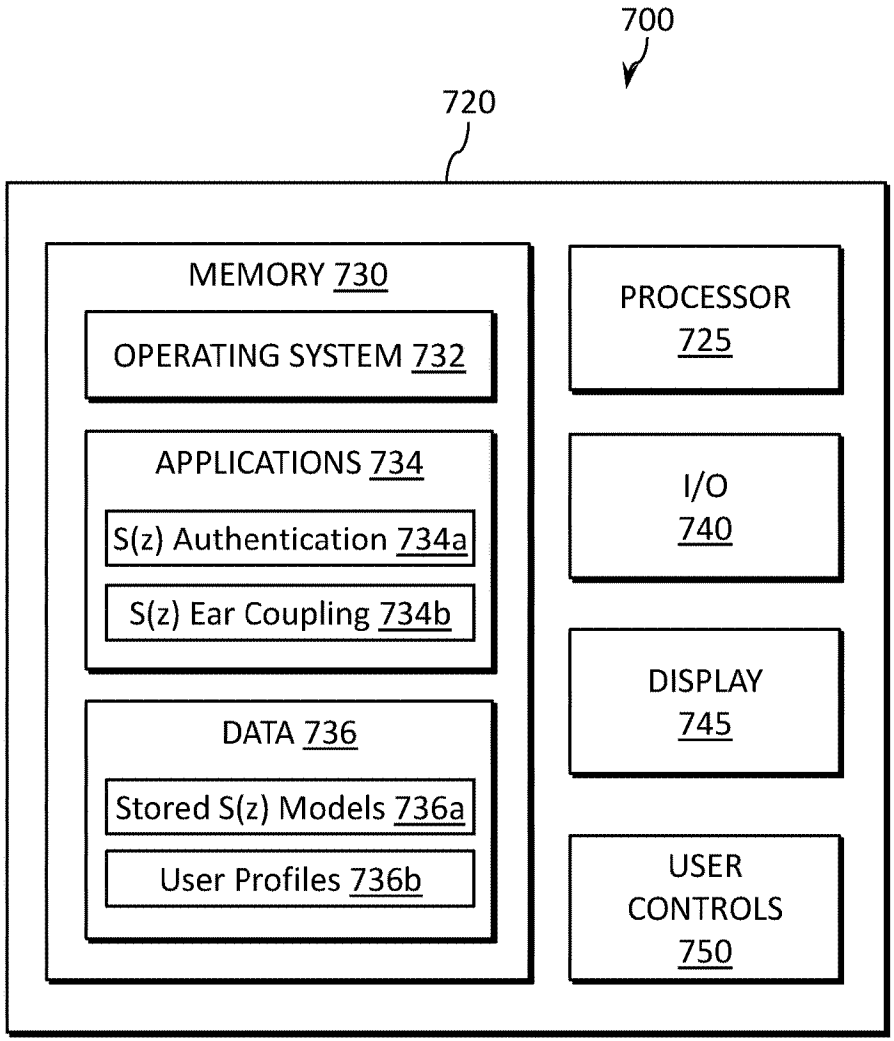
FIG. 7 illustrates an example implementation of an ANC system with secondary path identification, in accordance with one or more embodiments.

As discussed, the various techniques provided herein may be implemented by one or more systems which may include, in some embodiments, one or more subsystems and related components thereof. For example, FIG. 7 illustrates a block diagram of an example hardware system 700 in accordance with an embodiment of the disclosure. In this regard, system 700 may be used to implement any desired combination of the various blocks, processing, and operations described herein, including implementing one or more blocks of the host device 230, wireless earbud 210, system 100, and other systems, devices and components referred to herein. Although a variety of components are illustrated in FIG. 7, components may be added and/or omitted for different types of devices as appropriate in various embodiments.

As shown, system 700 includes input/output 740 which may include, for example, audio input/out interface for connecting the system 700 to a headset. The system 700 includes a processor 725, a memory 730, a display 745, and user controls 750. Processor 725 may be implemented as one or more microprocessors, microcontrollers, application specific integrated circuits (ASICs), programmable logic devices (PLDs) (e.g., field programmable gate arrays (FPGAs), digital signal processors, complex programmable logic devices (CPLDs), field programmable systems on a chip (FPSCs), or other types of programmable devices), codecs, and/or other processing devices.

In some embodiments, processor 725 may execute machine readable instructions (e.g., software, firmware, or other instructions) stored in memory 730. In this regard, processor 725 may perform any of the various operations, processes, and techniques described herein. In other embodiments, processor 725 may be replaced and/or supplemented with dedicated hardware components to perform any desired combination of the various techniques described herein.

Memory 730 may be implemented as a machine-readable medium storing various machine-readable instructions and data. For example, in some embodiments, memory 730 may store an operating system 732 and one or more application 734 (e.g., Sz Authentication 734*a*, Sz Ear Coupling 734*b*, and other applications) as machine readable instructions that may be read and executed by processor 725 to perform the various techniques described herein. Memory 730 may also store data 736 used by operating system 732 and/or applications 734, including Stored S(z) Models 736*a* (e.g., models illustrated in FIG. 5) and User Profiles 736*b*, as described herein. In some embodiments, memory 730 may be implemented as non-volatile memory (e.g., flash memory, hard drive, solid state drive, or other non-transitory machine-readable mediums), volatile memory, or combinations thereof.

Display 745 presents information to the user of system 700. In various embodiments, display 745 may be implemented as a liquid crystal display (LCD), an organic light emitting diode (OLED) display, and/or any other appropriate display. User controls 750 receive user input to operate system 700 (e.g., to adjust parameters as discussed). In various embodiments, user controls 750 may be implemented as one or more physical buttons, keyboards, levers, joysticks, and/or other controls. In some embodiments, user controls 750 may be integrated with display 745 as a touchscreen.

In various embodiments, system 720 may be used to provide active user tuning of an acoustic noise cancellation device, such as a set of headphones connected to the system 720 through I/O 740. In such embodiments, processor 725 may run an application stored in memory 730 providing a graphical user interface displayed on display 745 and controlled by user controls 750 for adjusting parameters of the acoustic noise cancellation device.

Figure 8:
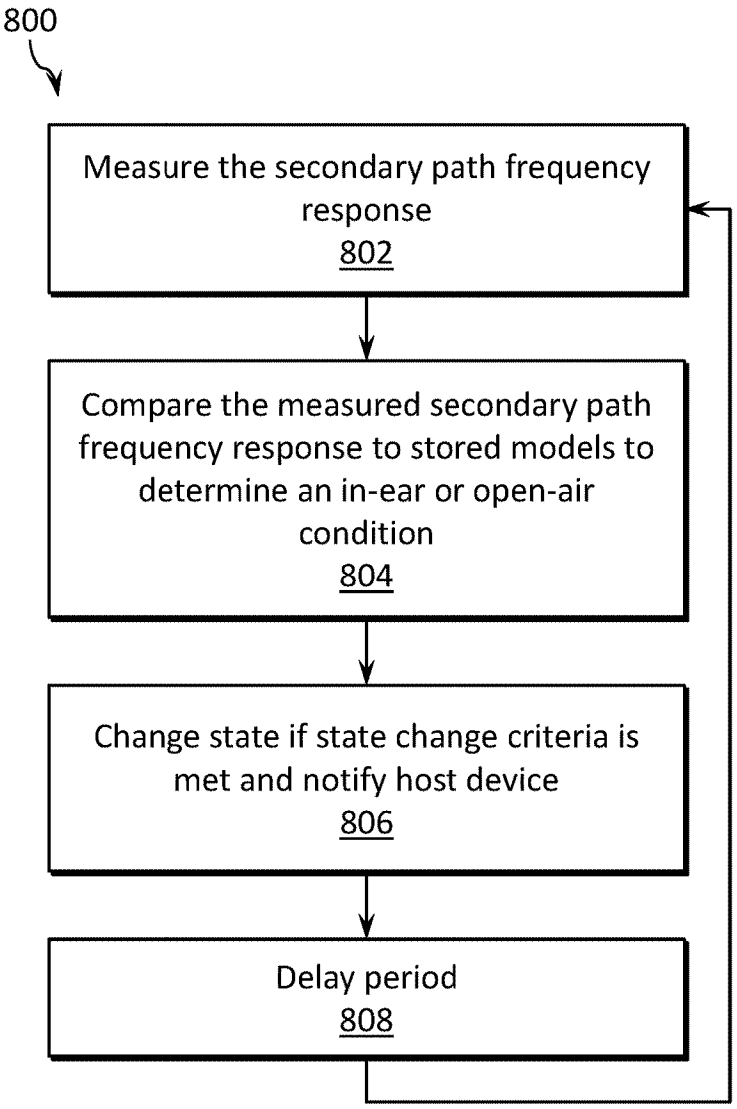
FIG. 8 illustrates an example process for determining a change between an in-ear and an open-ear state, in accordance with one or more embodiments.

Referring to FIG. 8, an example process 800 for determining a change between an in-ear and an open-ear state will now be described, in accordance with one or more embodiments. In the process 800 may be performed by a personal listening device (e.g., earbuds, earphones, another in-ear listening device, etc.), a host system (e.g., a mobile phone, a laptop computer, etc.) or another connected device. During use of the personal listening device, the system may periodically check the in-ear/open-air state, which may be used, for example, to preserve battery life. In step 802, the system measures the secondary path frequency response as disclosed herein. In some embodiments, the personal listening device is outputting a sound (e.g., music, voice, etc.) through its loudspeaker which may be used to measure the secondary path frequency response. If no sound is being played, then the system may briefly output a sound from the loudspeaker (e.g., white noise, pink noise, a sound outside the range of human hearing, etc.) for use in measuring the secondary path response through the error microphone.

In step 804, the system compares the measured secondary path frequency response to stored models to determine an in-ear and/or open-air state. In some embodiments, the measured secondary path frequency response is compared against stored user models, and if a confidence factor is below a threshold value, then an open-air condition is determined. In another embodiment, the stored models include one or more models of an open-air condition and a fit to an open-air model with a confidence factor exceeding a threshold can be used to determine an open-air condition.

In step 806, if state change criteria are met then the system changes the in-ear/open-air state and notifies the host. In some embodiments, the system is configured to change immediately to an in-ear state when an in-ear condition is met. In some embodiments, the system is configured to change to an open-air state after an open-air state is detected across a plurality of measurements to reduce the chance of a false open-air detection. The host system may use the change in state to configure a power management setting (e.g., enter a sleep mode in an open-air state), adjust a volume setting, or perform other actions. In various embodiments, the system periodically checks the in-ear/open air state (e.g., once every 1 second, 5 seconds, or other time interval) according to a duty cycle and waits through a delay period (step 808) before taking the next measurement.

The foregoing disclosure is not intended to limit the present disclosure to the precise forms or particular fields of use disclosed. As such, it is contemplated that various alternate embodiments and/or modifications to the present disclosure, whether explicitly described or implied herein, are possible in light of the disclosure. Having thus described embodiments of the present disclosure, persons of ordinary skill in the art will recognize that changes may be made in form and detail without departing from the scope of the present disclosure. Thus, the present disclosure is limited only by the claims.

What is claimed is:

1. An active noise cancellation system comprising:

a secondary path comprising:

a loudspeaker configured to output an anti-noise signal to cancel noise in a noise cancellation zone; and an error microphone configured to sense sound in the noise cancellation zone; and a logic device configured to adaptively generate the anti-noise signal for playback through the loudspeaker based at least in part on a feedback signal from the error microphone;

wherein the logic device is further configured to identify a user of the active noise cancellation system based, at least in part, on a measured frequency response of the secondary path.

2. The active noise cancellation system of claim 1, wherein the logic device is further configured to identify the user of the active noise cancellation system through a comparison of the measured frequency response of the secondary path to stored models.

3. The active noise cancellation system of claim 2, wherein the logic device is further configured to load a stored user profile associated with the identified user when the identified user is a known user.

4. The active noise cancellation system of claim 2, wherein the logic device is further configured to execute an enrollment process when then identified user is a new user.

5. The active noise cancellation system of claim 4, wherein the enrollment process comprises configuring and storing an active noise cancellation profile for the identified user based on tracking active noise cancellation tuning parameters and/or user preferences.

6. The active noise cancellation system of claim 2, wherein the logic device is further configured generate the stored models by:

identifying one or more users;

instructing each user to insert an in-ear active noise cancellation device while sound is emitted through the loudspeaker;

measuring a secondary path frequency response for the user and active noise cancellation device while it is inserted into an ear of the user; and storing a secondary path frequency response model for the user and user identification data.

7. The active noise cancellation system of claim 1, wherein the logic device is further configured to identify the user of the active noise cancellation system based, at least in part, on a measured frequency response of the secondary path, by:

detecting use of an in-ear active noise cancellation device;

measuring the secondary path frequency response of the user while sound is emitted from the loudspeaker;

determining whether the measured secondary path frequency response matches a stored user model; and when a match is found, identifying the user to a host system and load an associated user profile.

8. The active noise cancellation system of claim 7, wherein the user profile comprises stored coefficients for at least one adaptive filter of the active noise cancellation system; and wherein the logic device is further configured to adapt filter coefficients of at least one adaptive filter in active noise cancellation system.

9. The active noise cancellation system of claim 1, further comprising:

a reference microphone configured to sense ambient noise and generate the reference signal corresponding thereto; and wherein the error microphone is configured to sense a mix of the ambient noise and the anti-noise signal in a noise cancellation zone and generate a corresponding error signal.

10. The active noise cancellation system of claim 1, wherein the logic device is further configured to detect coupling of an in-ear active noise cancellation device to an ear of the user, wherein the detected coupling comprises an in-ear state or open-air state.

11. A method for operating an active noise cancellation system comprising:

generating, by a signal processor, an anti-noise signal adapted to cancel ambient noise;

outputting, through a loudspeaker, the anti-noise signal to cancel the ambient noise;

sensing, by an error microphone, a mix of sounds comprising the ambient noise and the anti-noise signal;

feeding back the sensed mix of sounds to the signal processor for use in adapting the anti-noise signal; and identifying a user of the active noise cancellation system based, at least in part, on a measured frequency response of a secondary path comprising the loudspeaker and the error microphone.

12. The method of claim 11, further comprising identifying the user of the active noise cancellation system through a comparison of the measured frequency response of the secondary path to stored models.

13. The method of claim 12, further comprising loading a stored user profile associated with the identified user when the identified user is a known user.

14. The method of claim 12, further comprising executing an enrollment process when then identified user is a new user.

15. The method of claim 14, wherein executing the enrollment process further comprises configuring and storing an active noise cancellation profile for the identified user based on tracking active noise cancellation tuning parameters and/or user preferences.

16. The method of claim 12, further comprising generating the stored models by:

identifying one or more users;

instructing each user to insert an in-ear active noise cancellation device while sound is emitted through the loudspeaker;

measuring a secondary path frequency response for the user and active noise cancellation device while it is inserted into an ear of the user; and storing a secondary path frequency response model and user identification data.

17. The method of claim 11, further comprising identifying the user of the active noise cancellation system based, at least in part, on a measured frequency response of the secondary path, by:

detecting use of an in-ear active noise cancellation device;

measuring the secondary path frequency response of the user while sound is emitted from the loudspeaker;

determining whether the measured secondary path frequency response matches a stored user model; and when a match is found, identifying the user to a host system and load an associated user profile.

18. The method of claim 17, wherein the user profile comprises stored coefficients for at least one adaptive filter of the active noise cancellation system; and wherein the method further comprises to adapting filter coefficients of at least one adaptive filter in active noise cancellation system.

19. The method of claim 11, further comprising:

sensing the ambient noise through a reference microphone and generating a reference signal corresponding thereto; and sensing, through the error microphone, a mix of the ambient noise and the anti-noise signal and generating a corresponding error signal.

20. The method of claim 11, further comprising detecting coupling of an in-ear active noise cancellation device to an ear of the user, wherein the detected coupling comprises an in-ear state or open-air state.

* * * * *